US008276240B2

(12) United States Patent
Ritachka

(10) Patent No.: US 8,276,240 B2
(45) Date of Patent: Oct. 2, 2012

(54) DOOR MOUNTED FINGER SAFETY DEVICE

(76) Inventor: Roman Ritachka, Weaverville, CA (US)

( * ) Notice: Subject to any disclaimer, the term of this patent is extended or adjusted under 35 U.S.C. 154(b) by 384 days.

(21) Appl. No.: 12/585,059

(22) Filed: Sep. 2, 2009

(65) Prior Publication Data

US 2010/0050377 A1 Mar. 4, 2010

Related U.S. Application Data

(60) Provisional application No. 61/136,404, filed on Sep. 3, 2008.

(51) Int. Cl.
*E05F 5/04* (2006.01)

(52) U.S. Cl. ..... 16/83; 16/82; 16/85; 16/86 A; 16/86 B; 292/342; 292/343

(58) Field of Classification Search ..... 16/82, 83, 16/85, 86 A, 86 B; 292/288, 342, 343
See application file for complete search history.

(56) References Cited

U.S. PATENT DOCUMENTS

| | | | | |
|---|---|---|---|---|
| 900,621 | A | 10/1908 | Voight | |
| 1,258,856 | A | 3/1918 | Beaudette | |
| 2,565,906 | A | 8/1951 | Berthane | |
| 3,243,836 | A * | 4/1966 | Reiss | 16/85 |
| 3,287,050 | A | 11/1966 | Ferrante | |
| 3,620,483 | A | 11/1971 | Weinberger | |
| 3,800,360 | A * | 4/1974 | Knarreborg | 16/83 |
| 3,831,989 | A * | 8/1974 | Gurzenda | 292/338 |
| 4,261,140 | A | 4/1981 | McLean | |
| 4,982,474 | A * | 1/1991 | Kjellstrom | 16/82 |
| 5,123,685 | A | 6/1992 | Donovan | |
| D346,109 | S | 4/1994 | Comainni | |
| D347,570 | S | 6/1994 | Burge | |
| 5,727,285 | A * | 3/1998 | Goman | 16/38 |
| 5,771,533 | A * | 6/1998 | Kuang-Pin | 16/82 |
| 6,510,587 | B2 * | 1/2003 | Urschel et al. | 16/83 |
| 6,550,828 | B2 | 4/2003 | Warden | |
| 7,937,806 | B1 * | 5/2011 | Doyle | 16/82 |
| 2002/0174513 | A1 * | 11/2002 | Hodson | 16/85 |

* cited by examiner

*Primary Examiner* — Victor Batson
*Assistant Examiner* — Emily Morgan
(74) *Attorney, Agent, or Firm* — Donald Grant Kelly

(57) ABSTRACT

A door check device to be mounted to a door for selectively maintaining a gap when door closing is attempted. This prevents injuries to children's fingers and the like. The door check includes a base with a journal having action arm pivoted at its proximal end. The arm has a distal end extending outwardly to engage a doorstop. Indexing sockets are formed along the arm's proximal end. Each socket collaborates with the nose of a spring-biased detent to retain the action arm in a preselected position. The arm may be set in a first position to directly engage the doorstop to form a gap. Set in a second position the arm allows door closing but, upon next opening, the arm automatically reverts to door checking position. In a third position the arm is fully lowered to disable the check device. This device may find application to a variety of closures.

5 Claims, 6 Drawing Sheets

DOOR MOUNTED FINGER SAFETY DEVICE

REFERENCE TO RELATED APPLICATIONS

This application is entitled to the benefit of provisional patent application Ser. No. 61/136,404 filed Sep. 3, 2008; such benefit is hereby claimed under 35 USC 119(e) and the content of said application in its entirety and for all purposes is incorporated herein by reference.

STATEMENT REGARDING FEDERALLY SPONSORED RESEARCH OR DEVELOPMENT

Not applicable

REFERENCE TO SEQUENCE LISTING

Not applicable

BACKGROUND OF THE INVENTION

1. Field of the Invention

The invention disclosed herein generally relates to the field of door hardware and more specifically to mechanisms for preventing a door or equivalent closure from fully closing by mechanically maintaining at least a small gap along each lateral edge, thereby keeping the door slightly ajar. Described herein are a unique gap-retaining mechanism and its method of use.

Each year, tens of thousands of children in the United States receive serious injuries when closures accidentally engage their fingers. Sadly, an alarming number of these result in at least partial amputation. Described herein are a device and method of using the unique device embodying novel and non-obvious advancements to address this growing problem.

2. Description of Related Art

Various alternatives currently exist for maintaining a door or similar closures slightly open or ajar. Over the years a number of names for such anti-closure devices and their assigned functions with respect to doors, gates, windows, drawers and the like have entered the common lexicon. For example, a device for maintaining an open gap might be variously referred to as a check, stop, brace, spacer, hook, prop or simply a "hold-open". These devices have been developed with a variety of objectives, among these are: avoiding unexpected closure injury to a small child or pet; keeping a closure from unwanted latching or locking; maintaining a closure in open or unlatched state for temporary periods for ventilation, passage or observation; maintaining a door or window to a baby's nursery or other important space slightly ajar for monitoring purposes. For simplicity and without intention to delimit the present invention, these and similarly purposed devices are herein referred to as door checks.

Over the years many door checks have been invented and commercialized for purposes such as just described, and many of those inventions have been patented. Examples of patent documents addressing the need for keeping a door ajar include the following. U.S. Pat. No. 6,550,828 to Warden shows door gap retention by way of clamps and inserted panels. U.S. Pat. No. 1,258,856 to Beaudette depicts a nursery door check that slows the door swing and subsequently permits closure with added pressure. U.S. Pat. No. 2,565,906 to Berthane demonstrates a device for retaining doors ajar. The Berthane device features a yoke configured to fit over the top of a door and a bumper that extends therefrom to engage the door's sill.

Comaianni's U.S. Pat. No. D346,109 illustrates a door spacer mechanism attached to a door frame and appears to present an arm in two positions: a first position where the arm is extending above a door; a second position where the arm extends downwardly apparently to check a door. Ferrante's U.S. Pat. No. 3,287,050 discloses an adjustable brace fixed to a door jamb and engaging a door edge to maintain the door in fully open position. Ferrante's brace swings clear to permit closure. U.S. Pat. No. 4,982,474 granted to Kjellstrom prevents door crushing injuries by providing a check device in the form of a spring biased blocking component attached to a door and articulated to engage the door case to prevent the door's closure.

U.S. Pat. No. 6,510,587 to Urschel et al. describes a device for temporarily preventing a door closure upon its first opening; but, upon the door's reopening, the device permits closure. This device is fairly complex in its number of parts. U.S. Pat. No. 900,621 to Voight shows a mechanism mounted on the upper portion of a door casing and extending to engage the top of a swinging door. Voight's invention is for holding the door slightly ajar to indicate that a room currently is unoccupied. To disengage the mechanism so that passage is permitted, the door is further opened for passage and then may be fully closed. The Voight arrangement is for indicating room availability and without regard to safety, ventilation and the like.

Weinberger's U.S. Pat. No. 3,620,483 includes a door holding yoke that extends to, and embraces, a portion of the door frame or directly interconnecting to a frame-mounted rail with an engagement bead. U.S. Pat. No. D347,570 was issued to Burge for a resilient door stop element that fits about a door edge to prevent door movement. Donovan's U.S. Pat. No. 5,123,685 discloses a sliding leg mounted on a door and arranged to abut a door jamb to keep the door ajar. McLean's U.S. Pat. No. 4,261,140 Features a checking element that falls into door-blocking position when the door is opened.

The record will show that each of the aforementioned patent documents in its entirety was incorporated by reference in the above noted Provisional Patent Application. Upon close review of the patents discussed hereabove, it is apparent that they address similar objectives, but do so through a variety of mechanical constructs substantially different from the present invention. Moreover, none offers the unique configuration and distinct functional advantages afforded by the present invention described and claimed as follows.

BRIEF SUMMARY OF THE INVENTION

The present invention has a principal focus on safety, and is presented as a device designed and configured particularly to prevent accidental injuries to children and pets, though not limited thereto. For example, the described device would be mounted on the closing face of a door. Again, it is important to understand that the term "door" is not intended to limit the invention as to its sole environment of application. Indeed, the invention may have application with respect to closures in any of a variety of applications including, for example: room doorways and entranceways; patio windows/doors; bathroom shower doors, garage side entrances and so forth. Moreover, the present invention may be configured to apply to cabinet doors or drawers, trunk lids, and equivalents thereof. For simplicity and brevity, however, the present invention will be described in the context of a door and doorway environment.

In typical carpentry jargon, the term "doorstop" is commonly applied to the strip of molding, ranging in width from one inch to several inches. The doorstop usually is recessed or set back from the door frame facing by a distance roughly equal to the door thickness and provides a limiting position for door closure (hence the term "stop"). Major objectives served by the doorstop are both functional and aesthetic: to prevent a closing door from "swinging through" the doorway casing, and to support the door such that its visible surface is on a plane consistently level with the door frame facing. The doorstop strip typically borders the door jamb and also hides the gap between the door and the jamb. For more information in this respect, readers' attention is directed to the Internet world wide web (www) address for metaglossary.com/meanings/855932. Typically, the open right angle formed at the joinder of strips of wood (for example, between the door stop and jamb, is known by the woodworking expression "reveal." These structural relationships often appear in other closures, as well, for example: trunks, windows and the like.

The phrase "closing face" as used herein to reference the substantially flat, major surface of a door, bound by its four associated edges. More specifically, the closing face is the door surface that swings within the door casing toward a door frame, jamb and doorstop as the door is "closed." When fully closed, the door generally engages within the doorstop "reveal" where its swinging motion is arrested. The door typically engages the doorstop at its reveal along the door's top edge and two lateral (generally vertical surface) edges, respectively at its latch and hinge sides. The bottommost, generally horizontal door surface/edge may, or may not, face an abutting threshold doorstop. The inventive door check to be more fully described below is configured to engage the doorstop, and it is equally effective in preventing injuries at all such edges. The typical application of the inventive door check is at the topmost door edge, though the invention should not be considered so limited.

The inventive door check device includes an action arm pivotally attached at its proximal end to a base member. The door check base member is configured to be suitably mounted on the door's closing face. The base member may be configured to be mounted to the door through an intermediate wedge or shim element. This results in an angular orientation of the door check action arm relative to the door surface. As the door and the angularly extended action arm are swung toward the doorstop, the door check's angular orientation relative to the closing face of the door results in a substantially normal (right angle) approach to the doorstop. This substantially normal approach minimizes lateral or bending forces on the arm, thus commanding a less robust arm construction. It also lessens scuffing damage to the doorstop.

The proximal end of said action arm terminates in an arcuate portion pivoted or journalled about an axis pin within a journal structure on the base. The journal structure may include pivot block elements either affixed to, or integral with, the door check base. The action arm extends from its journalled location outwardly to a distal end configured to engage the doorstop. The action arm arcuate portion is configured to turn about its journal pivot at said pivot block elements so as to place the arm in each of (at least) three different modes or positions. For example, the action arm may swing upwardly to a position slightly above horizontal—herein described as the action arm's "door check position." Alternatively, the action arm may be swung downwardly somewhat below horizontal to a midway position—herein described as the action arm's "trigger re-set position." Upon further swinging movement about the axis pin, the action arm may retreat fully downwardly to its "disabled position" where it essentially is out of service.

When in its "trigger re-set position," an uppermost "trigger" corner portion of the action arm proximal end protrudes or juts slightly beyond the base journal pivot block elements so as to be exposed at an upper extreme of the door check device. This "protruding trigger corner" configuration is key to the functionality of the inventive door check device. The action arm may be set in each of the above-mentioned (at least) three positions by a keeper mechanism comprising a resiliently biased nose or ball detent projection (for example, a spring-biased detent ball) configured to engage with indexing detent sockets or depressions defined along the surface of said arcuate portion.

For example, with the resilient detent engaged in the defined socket or depression closest to the action arm's very proximal end, the action arm is set in its door checking position. The next defined depression formed along the action arm cooperates with the resilient detent to set the door check device in its trigger re-set mode. Next after that is the defined depression for optionally setting the action arm in a disabled mode. These settings are temporary conditions or modes achieved either by hand or by force of door check/doorstop interaction, to be explained.

The inventive door check device is affixed to the door's closing face, substantially at the door's uppermost edge. Reasonably precise door check device placement is important. This enables the entire door check device (in its trigger re-set mode or position) to glide beneath the doorstop as the closing face of the door engages the doorstop. As it traverses beneath the doorstop, the uppermost "trigger" corner of the proximal end of the action arm interferes with the doorstop and tends to force the proximal end downward and, correspondingly, its distal end upwardly. As the arm tilts slightly upwardly (due to engagement of the jutting trigger corner with the doorstop), the resilient detent projection automatically biases the arm toward its door checking mode. When the door is subsequently opened, the action arm immediately snaps upwardly into its door check mode, ready to check the door when its next closing is attempted.

In another example, when the door check device is set in its disabled mode, the resultant arm position is tilted fully downwardly so far that the door check device glides beneath the doorstop without any interaction therewith. This is because, in the disabled mode, the very proximal end of the action arm just beyond its pivot axis is essentially flat (or even) with its associated journal block elements. In this configuration there is no upwardly projecting corner of the action arm proximal end. As long as the door check device is in disabled mode, no door checking takes place, no re-set action takes place, and no protection is afforded against injury. In this mode, it is as if the door check device is not present.

Whether, or not, the arm engages the doorstop depends on its action mode setting as governed by the positional engagement of the biased detent ball or nose projection in a defined detent socket or depression. For users with sufficient reach, mode settings may be changed by manually raising or lowering the arm's distal end. To accommodate other users where appropriate, a chain, cord or rod implement may be suitably attached.

Thus, the safety device, in its operative or activated position, prevents full closure of the door leaving a gap at the door's edges which is intended to be at least a predetermined width. Depending upon the intended use of the inventive device, the resultant gap achieved (wider or narrower) can be predetermined or preset by the device's initial placement and configuration. The gap, for example, may be selected at about the thickness of a child's largest finger or the width of a pet's tail.

While not intended as limiting this invention, an example of a minimal gap between the door and its normally closed position might be in the range of ⅜ inch—generally enough to prevent serious bone injury. This gap may be achieved where the inventive device is mounted near the upper edge of a typical door and spaced about 6 inches from its hinged edge.

This gap may be more or less extensive as determined by the location of the device attachment along the top edge of the door, and of course by the length of the action arm. For example, positioning the door check device closer to the door's hinge edge may require a shorter articulated arm. Positioning the device a greater distance from the door's hinge edge will, of course, change the parameters proportionally.

It must be kept in mind that the objective is to afford a relatively narrow gap at the door closure edges, including the hinge-gap located at the door edge opposite the doorknob/latch area. It bears repeating that the gap should be no narrower than a human's finger or other appendages or perhaps the tail, paw or nose of a pet. Gap choices for ventilation, pet passage and such may of course be considerably wider.

While this description is primarily focused on a child's safety, it will be apparent that the present device may enjoy other applications such as keeping a child from locking himself/herself in a room. As noted, still other uses may include: maintaining a ventilating air flow passage around a door while purposely held slightly ajar. Another application would be to prevent a wind gust from fully closing an open door. A storage trunk may be propped open with this inventive check device in order to aerate its contents. With many storage trunks having metal edges along the closing portions, the present invention can protect against injury. Thus, the invention herein described and claimed as having novel configuration and function should not be considered limited to any specific problem solution.

BRIEF DESCRIPTION OF THE DRAWINGS

The present invention will be best understood by reference to the following detailed description of an illustrative embodiment when read in conjunction with the accompanying drawings, wherein.

DETAILED DESCRIPTION OF THE INVENTION

Looking more closely at the inventive door check device 1 depicted in FIGS. 1-12, it will be seen that the principal operative element is the outwardly projecting, articulated impact or action arm 4. This action arm 4 and its associated components may be fabricated from any of a variety of source materials. These materials include but are not limited to plastic, wood, metal, and the like, bearing in mind that to be qualified a source material must be sufficiently substantial to withstand repeated compressive and shearing impacts. Since this inventive device 1 is intended for widespread use, it also is important that the selected source materials be relatively inexpensive and easily manufactured and assembled.

Figure 1:
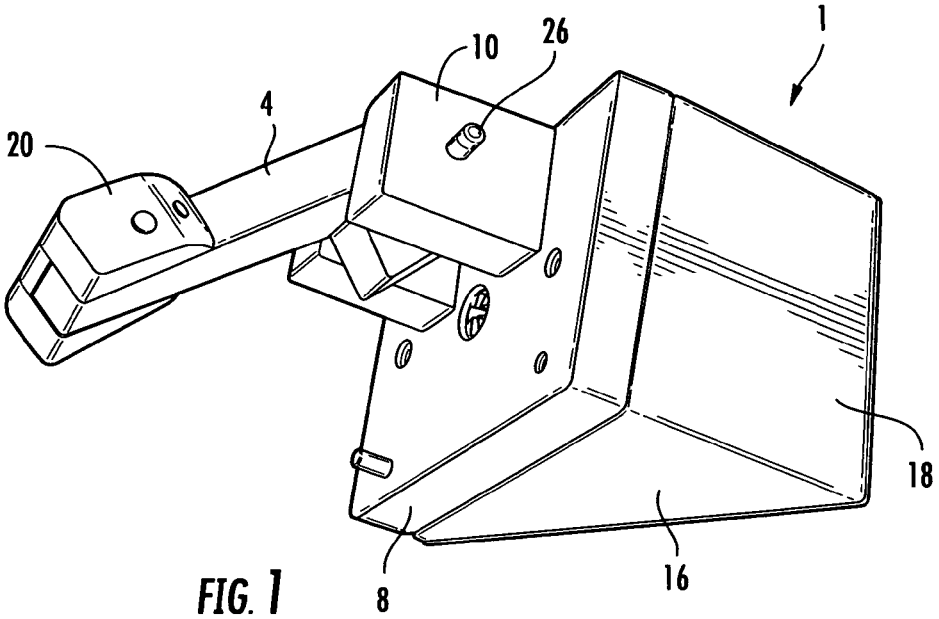
FIG. 1 shows a perspective view of the front side of the device with articulated action arm in slightly lowered position, or trigger re-set mode.
Figure 2:
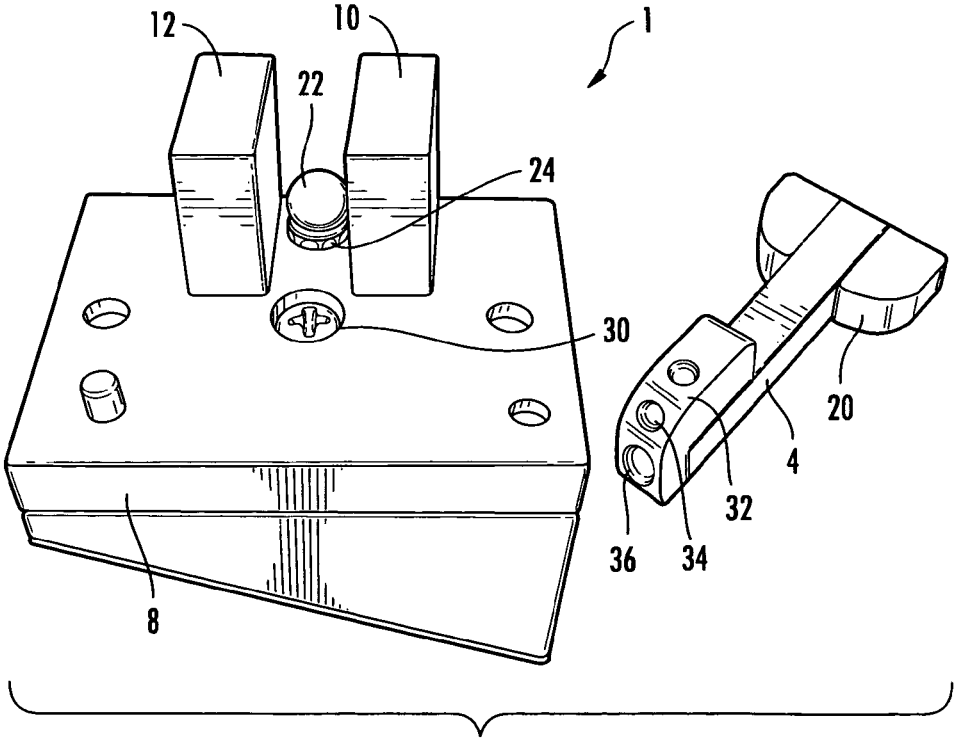
FIG. 2 is a perspective view of the device partially disassembled and with the action arm disconnected to reveal important mode setting details.

The door check device 1 with impact or action arm 4 as viewed in FIGS. 1 and 2 extends from a proximal end at a base 8 to which it is mounted on pivot pin 26 in journal bearing block elements 10 and 12 (integral with, or affixed to, the base 8). The action arm extends outwardly to a terminus at its distal impact end 20. The action arm's distal impact end 20 is seen as having a working portion serving as a door check 1 as it impacts face 44 of doorstop 42 (see FIGS. 8-11). A suitably resilient impact pad or plate can be provided to avoid damage to doorstop 44 as is well known in the art.

Figure 8:
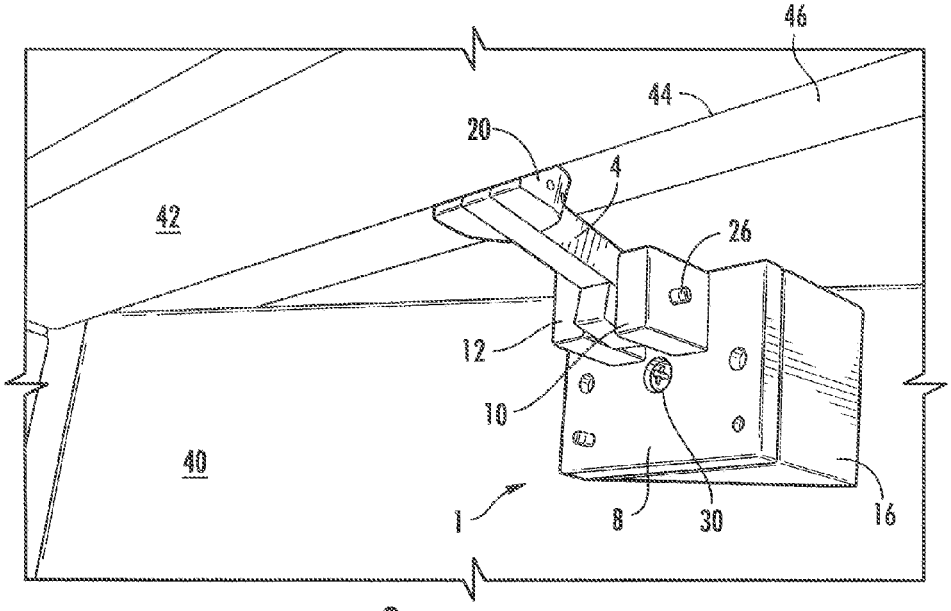
FIG. 8 is a front perspective viewed from below and showing the door check device mounted on a door, with the action arm in door checking mode and engaging the reveal of a generally horizontal doorstop within a door jamb.
Figure 9:
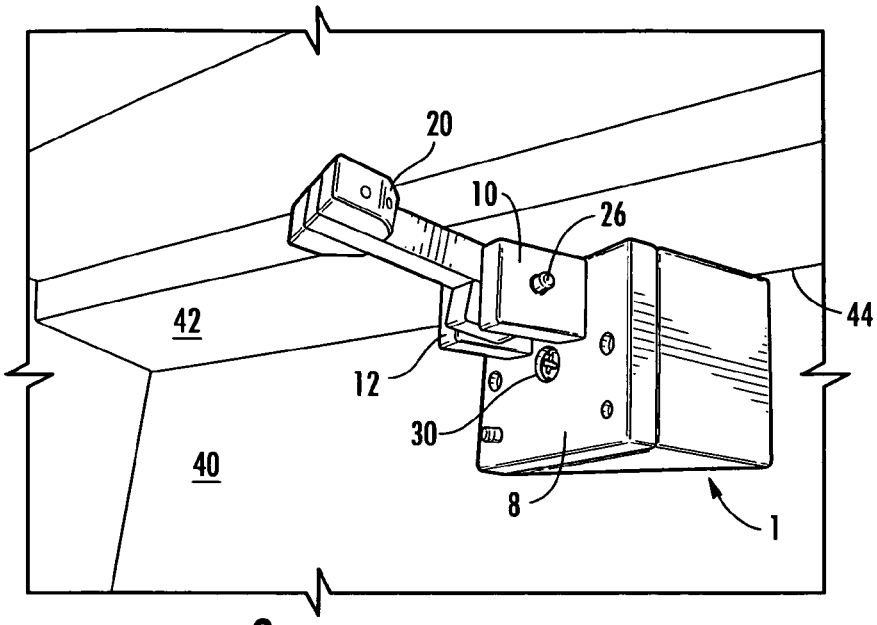
FIG. 9 is a perspective view similar to FIG. 8, showing the door stop on the face of a fully closed door, with the action arm biased upwardly as diagrammatically shown in FIG. 7A and ready for moving into door checking position when the door is reopened.
Figure 10:
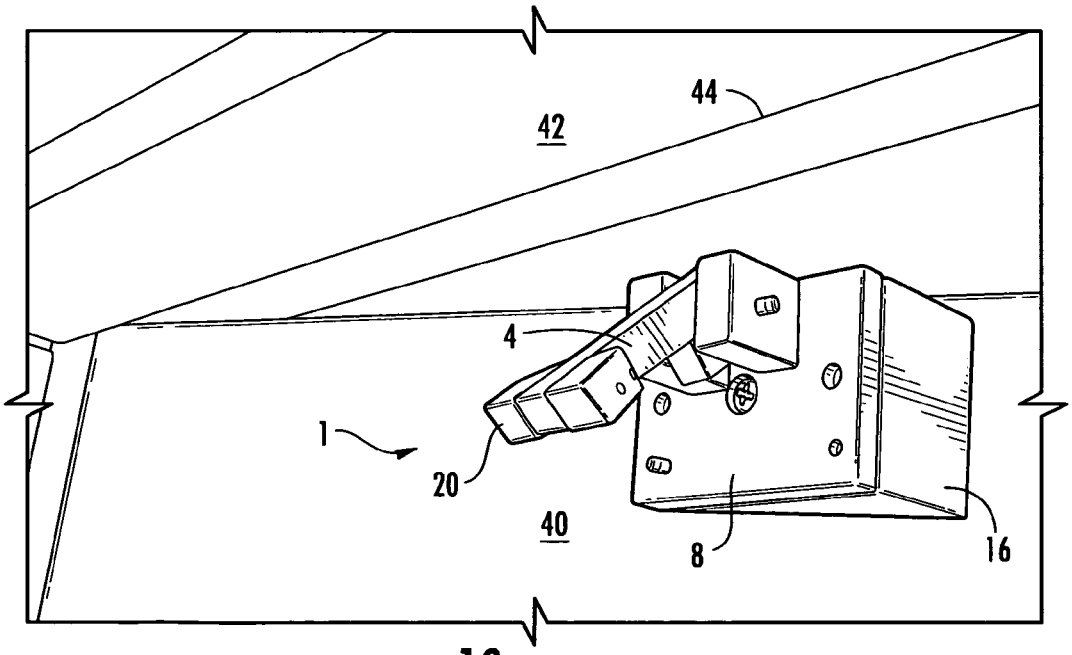
FIG. 10 is a perspective view similar to FIGS. 8 and 9, with the action arm in trigger re-set position or mode entering a door frame.
Figure 11:
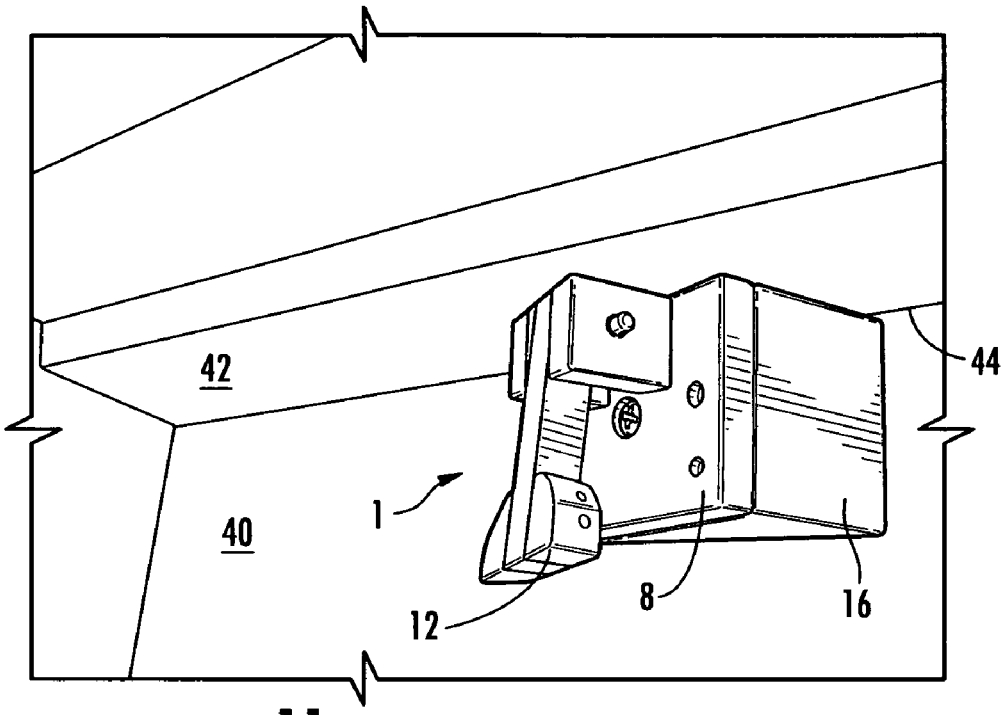
FIG. 11 is a perspective view similar to FIGS. 8-10, of a closed door with its door check device in a deactivated (disarmed) position so as to be essentially withdrawn from service.

It should be clear that the action arm 4 may be a single, integral element or an assemblage as indicated in FIGS. 1 and 8, and may present any appropriate shape as long as it has sufficient reach to achieve a desired gap (also suggested in FIG. 8) when engaged against a face 44 (FIG. 10) of doorstop 42 (FIGS. 9-11). Advantageously, action arm 4 would include a broadened impact surface at its distal end 20 (see FIGS. 1, 3, 9, 10). The purpose of broadening the impact surface is to reduce the possibility that the arm will be snapped off or that the arm will cause impact puncture damage to the wooden frame reveal. Distal end 20 may, of course be a single flattened element that is either integral with, or attached to, the arm 4. Other shapes may be adequate as will be explained. A resilient tip (not shown) may be added to distal end 20 if so desired.

Figure 5:
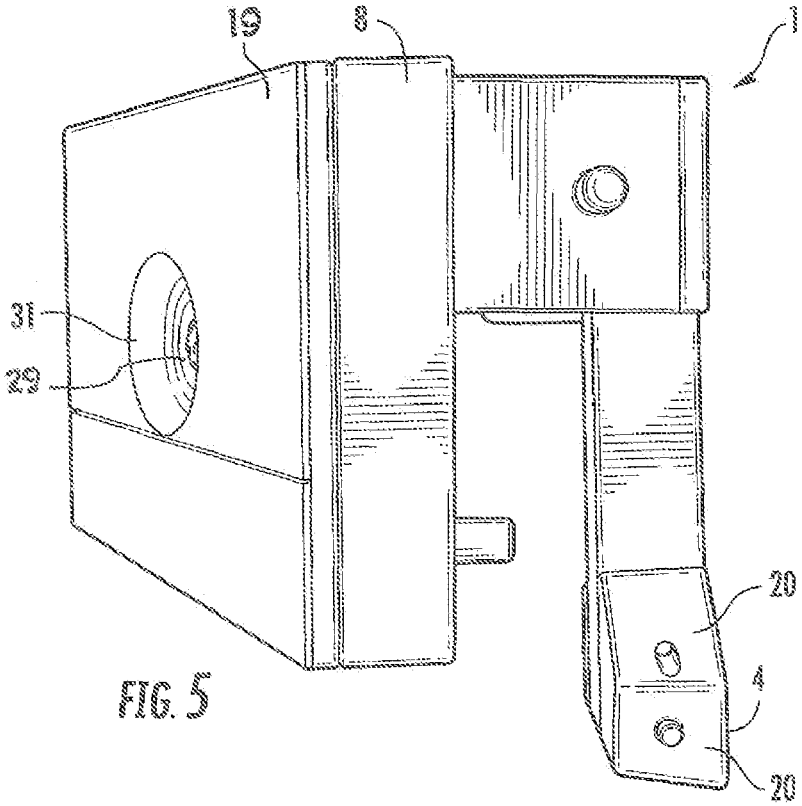
FIG. 5 is a backside perspective similar to FIG. 4, with the action arm placed in its inactivated, fully lowered position.
Figure 6:
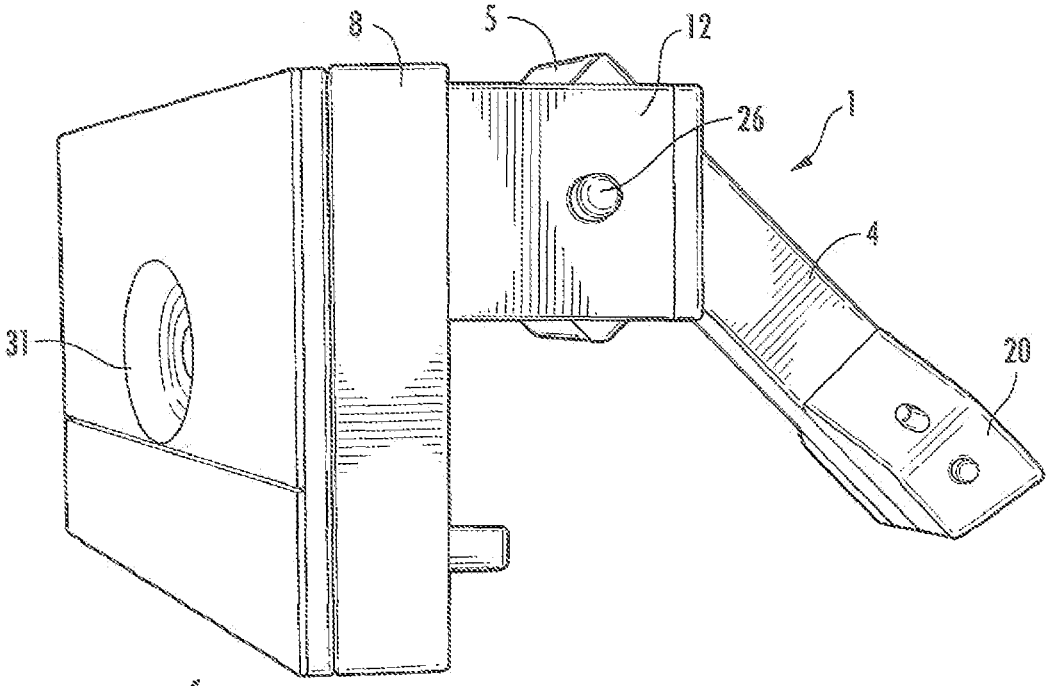
FIG. 6 is a backside perspective similar to FIG. 4, again showing the action arm in trigger re-set mode.

Device 1 base member 8, to which the articulated action arm 4 is pivotally journalled on pin axis 26, may be fastened to the door 40 (FIGS. 8-11) in any of a variety of ways. Base member 8 may be attached by removable attachment elements to intermediate wedge-shape shim element 16 (FIG. 9), for example by removable bolt 30 engagement with matching nut 29 in a rear face recess 31 of shim element 16 (FIGS. 5,6). However, alternative arrangements may be adequate, as well, as discussed below. The purpose of the wedge shape shim element 16 is further discussed below. The assembly of the arm 4, base member 8 and shim 16 may be (for example only) attached to the door by means of high strength two-sided adhesive tape 19 (FIG. 4).

The assemblage just described as including base member 8, action arm 4, journal bearing block elements 10, 12 along with shim or wedge 16 could be attached by other equivalent means involving threaded or unthreaded fasteners, rivets, glue, tape and such. Moreover, the entire unit including elements 8, 4, 10, 12 and bore hole 24 (FIG. 2) for spring biased detent 22, could be injection molded or otherwise fabricated as a single integral unit. There is, however, an advantage to the use of a separate shim element 16 as will be noted below.

It is important that force vectors resulting from contact of the distal end 20 of articulated action arm 4 as it impacts the door stop 42 reveal surface face 44 must be taken into consideration in device design. If the articulated arm 4 is mounted on a door surface 40 so as to be substantially perpendicular thereto, the dynamic angularity of door 40 movement toward the surface of doorstop reveal 44 will result in deflective shear of the articulated action arm 4. The intermediate wedge-shaped shim 16 serves to avoid breakage by initially positioning the articulated arm at a slight angle as now will be discussed.

Figure 4:
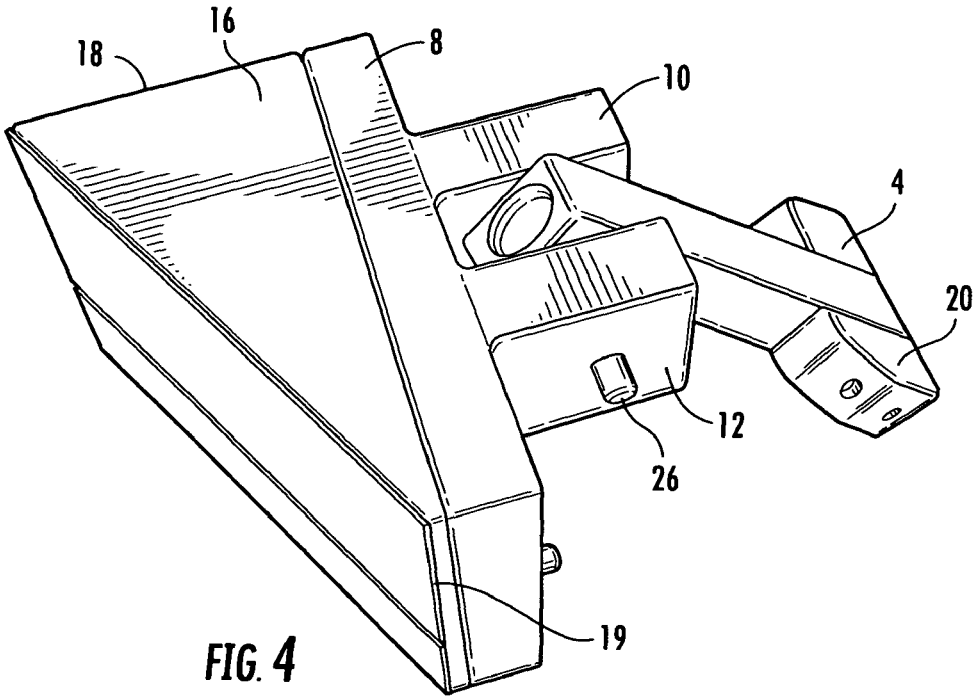
FIG. 4 is a backside perspective view of the device with the action arm partially lowered to its trigger re-set position or mode.

Shim 16 is fastened between the safety device 1 base member 8 and the door 40 (FIGS. 4, 9, 10). The shim 16 is shaped so as to be thicker at one lateral edge 18 thereof (i.e., laterally, side-to-side of the door's closing surface). The shim 16 configuration results in the articulated arm 4 projecting outwardly from the door 40 at an obtuse angle (FIG. 9). As the door 40 and angularly extended action arm 4 move toward the doorstop, the angle of arm 4 will result its substantial normal (right angle) impact at reveal 44. This will avoid angular shear forces upon impact. As a consequence of the reduced likelihood of shear, the articulated arm 4 can be fabricated to have a less robust configuration.

The direction of door swing must also be taken into consideration. It will be advantageous to be able to mount the device at an opposite edge of door 40 when its swing is in a different direction (i.e., closes toward left rather than right). However, the angularity of the action arm 4 relative to the door stop 42 reveal surface face 44 must also be reversed. Shim 16 thus is constructed as reversibly fastened by loosening bolt 30 and rotating the shim 16 a full 180-degrees (i.e., reversing placement of its thicker edge) to enable its use for either left-swing or right-swing doors.

Figure 12:
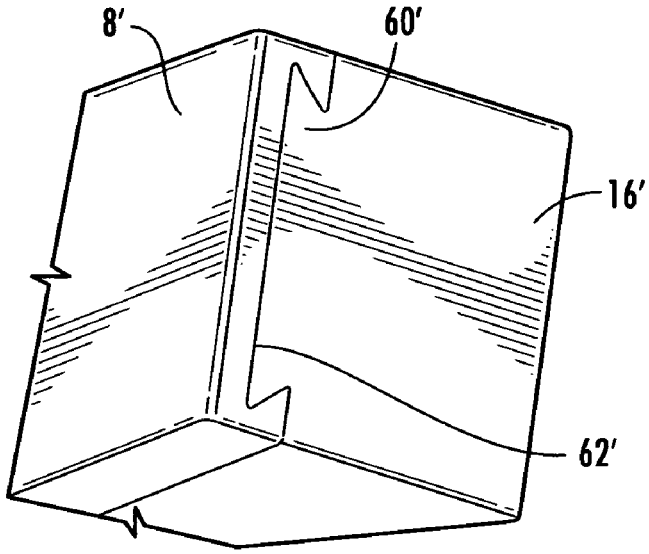
FIG. 12 is a partial perspective view of the door check device base and shim illustrating an optional reversible interconnection to accommodate both left and right swinging doors.

Alternatively, shim 16 and base 8 can be releasably interconnected by interfit elements such as a dovetail/groove interface thus avoiding all fasteners such as bolts, screws, friction clips and the like. For example, FIG. 12 shows a shim 16' with a tongue 60' feature configured to engage with an interference fit with corresponding groove 62' in base 8' (or, of course, vice versa). Shim 16' could be withdrawn from its matching groove on base 8' and turned 180-degrees for reversed engagement to base 8'. This reversal of shim 16' will serve to change the slant or angular direction of the device 1 to conform to either door swing direction as discussed above. Other well known interference or snap-fit configurations may be applied, as well. To ensure stable operation, detents or motion stops may be included within such interference fit arrangements as is well known in the art.

For the inventive door check device 1 to work most effectively, it is important that the articulated action arm 4 assume different positions relative to the doorstop 44. The proximal end of the action arm 4 terminates in an arcuate portion (see FIG. 2) pivoted about axis pin 26 (FIG. 1) within journal structure bearing block elements 10, 12 on base 8. Defined in a surface of arcuate portion of action arm 4 are indexing detent sockets or depressions 32, 34, and 36 as viewed in FIG. 2. These defined indexing detent sockets or depressions 32, 34, 36 are collaboratively juxtaposed to a resilient detent ball or nose projection 22 within spring bore 24 (FIG. 2). As the pivoted arcuate portion of arm 4 traverses the resilient detent ball or nose projection 22, the latter will spring selectively into each of said defined indexing detent sockets 32, 34, 36. This collaboration between arm 4 and detent ball or nose 22 serves temporarily to secure the action arm 4 in specific modes or positions.

Figure 3:
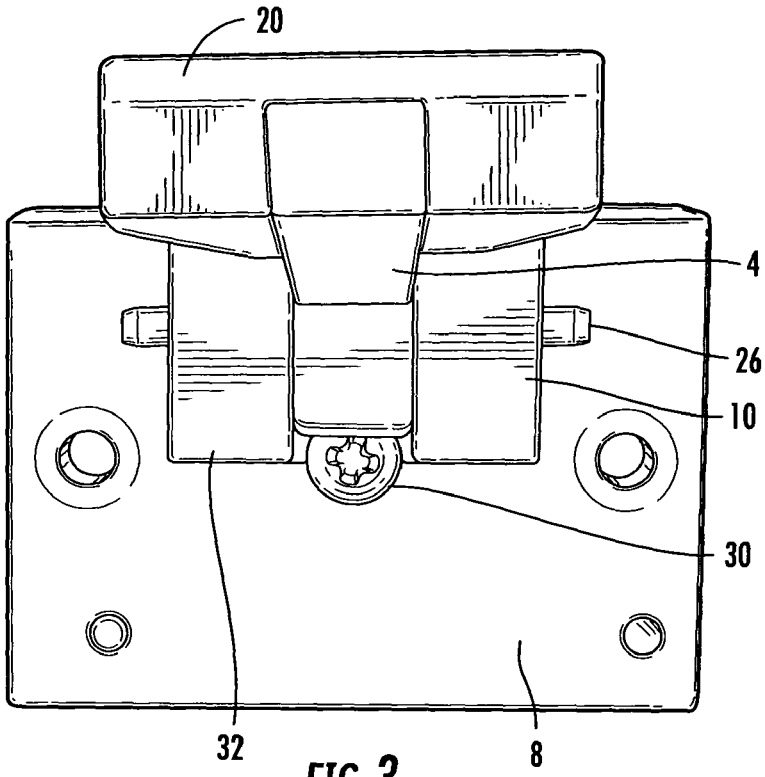
FIG. 3 is a front perspective of the device with the action arm in door checking mode.
Figure 7:
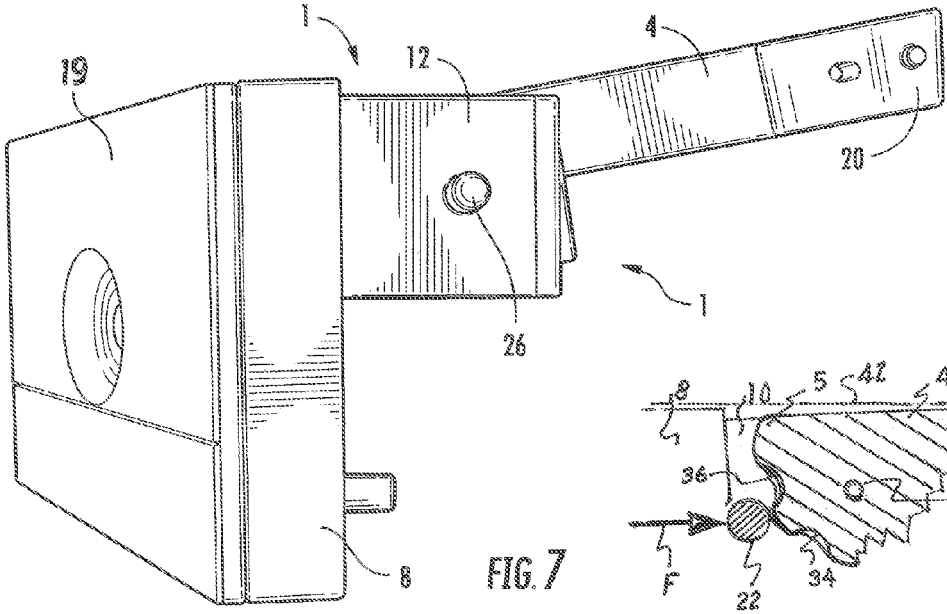
FIG. 7 is a backside perspective similar to FIGS. 5 and 6, with the action arm raised in door checking mode.

For example, when detent ball or nose projection 22 is biased into defined indexing detent socket 36, arm 4 is set or indexed for door check mode as best shown in FIGS. 3, 7, 8. In this position, arm 4 on door 40 approaches and directly engages doorstop face 44. Similarly, when detent ball or nose projection 22 is biased (see force F in FIG. 7A) toward defined detent socket 34, arm 4 is held in trigger re-set position or mode resulting in an upwardly protruding trigger corner 5 (see FIG. 6). In this latter mode, door 40 may be fully closed, but due to closing interference or interaction of the doorstop surface 42 with upwardly protruding trigger corner 5 depicted in FIG. 6, corner 5 along with socket 36 is slightly depressed just beyond biased engagement of detent ball or nose projection 22. Upon re-opening door 40, force F will cause the arm 4 to rise slightly such that the nose of resilient ball 22 will slip into defined socket 36, readying device 1 for door checking mode as shown in FIG. 7 preventing door re-closure. Finally, defined detent socket 32 is associated with the action arm 4 deactivated mode (FIGS. 5, 11). Thus, to withdraw the door check device 1 from service, the resilient detent ball or nose projection 22 is set into defined detent socket 32 such that arm 4 is relatively vertical and there is no upwardly protruding trigger corner 5 to cause further re-set (see FIGS. 5 and 11). Door 40 then operates in its normal state without interference from door check 1.

When use of the inventive door check device 1 is desired, a relatively tall person (e.g., an adult or older child) opens the door 40 and manually enables the articulated impact action arm 4 to its trigger re-set position or mode as depicted in FIGS. 1, 4, 6, 10. In this mode the action arm 4 pivots on pin 26 in bearing block elements 10, 12 so as to project outwardly and slightly downwardly from its base 8 and with trigger corner 5 protruding outwardly beyond said bearing elements 10, 12.

Figure 7A:
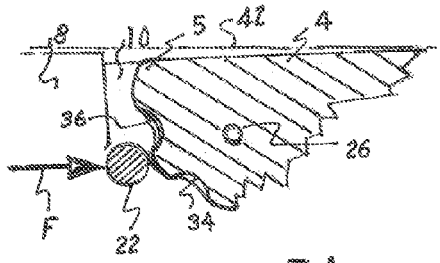
FIG. 7A is diagrammatic section view similar to FIG. 7, but depicting the action arm in its "trigger depressed" position relative to a door stop surface.

As the door 40 then is closed, the door check device 1 enters the door frame at doorstop 42 where it glides beneath doorstop face 44. But, as device 1 passes beneath doorstop face 44, the uppermost trigger corner 5 action arm 4 (see FIG. 6) engages against doorstop face 44 and doorstop 42 with just enough interference to cause the action arm 4 distal end to be raised very slightly (FIG. 9). This in turn depresses corner 5 and causes the detent or nose projection 22 to bias the action arm 4 proximal end toward engagement with the depression or socket 36 associated with the action arm 4 door checking mode. External pressure provided by the interfering doorstop 42 serves to hold corner 5 in its depressed position (FIG. 7A). When the door 40 is subsequently opened, action arm 4 automatically springs upward with biased detent ball or nose projection 22 fully engaging with indexing detent socket 36. This ensures arm 4 is automatically raised to door checking mode. Subsequent attempts to close the door 40 with inventive device 1 in this door checking mode will not be successful without adult intervention.

In summary, as a safety device this invention works by preventing a door from fully closing except by an adult or older child tall enough to disable the mechanism. The inventive door check device 1 mounts on the door 40 closing face.

The door check device 1 action arm 4, when extended, stops the door 40 from fully closing by engaging door stop face 44 wood trim, thus leaving a gap therebetween. Depending on the lateral distance from the edge of the door where the device is mounted, the space or gap (see FIG. 8) between the door and the jamb (on the hinge side) can be regulated.

This door check device 1 not only helps prevent injuries from the hinge side of the door, but also the side that normally closes. It can be disabled by putting the arm 4 in its fully lowered position. For normal operations, the door 40 is opened and action arm 4 is placed in door checking position (indexed to extend slightly above horizontal). To dose the door 40 an adult or older child would need to flip arm 4 to a slanted position associated with its re-set mode. When the door 40 subsequently is re-opened, arm 4 springs up automatically and subsequently prevents the door 40 from closing fully, thus preventing injury.

Since the base 8 shim 16 can be reversed as explained, door check device 1 will accommodate left or right hinged doors (40). Tip 20 of arm 4, where it contacts the door stop is shown as widened to distribute the energy on impact so as to avoid damaging the door 40. Depending on materials employed, additional nailing or other fasteners may be necessary to ensure proper operation.

This invention boasts a number of novel features and advantages: prevents injury at all four edges of door 40; readily deploys by simply flipping arm 4; continuously operates in door check mode without constant re-set; does not include loose parts or items that can pose danger to infants or may be misplaced or lost; does not need to be removed from the door in order to cease its blocking action; use of the device does not impart permanent damage to the door (thus, it may be removed as children grow older); safeguards people of all ages from injury; may be fabricated at reasonable cost; simple to install and operate.

Although various embodiments of the present invention have been presented in the foregoing detailed description and accompanying drawings, it will be understood that the description is meant to be illustratively only and in no way limited to the embodiments disclosed. The present invention may assume numerous arrangements, rearrangements, modifications, and substitutions of steps without departing from the spirit of the invention or from the scope of the following claims.

I claim:

1. A door check for use in selectively maintaining a predetermined gap between a door closing face and a door frame, said door check comprising:

a base including an attachment element for securing said door check to said door, said base further including journal block elements;

said door check further including an action arm with a distal end and a proximal end, said action arm pivotally mounted near its proximal end in said journal block elements;

said action arm proximal end is further defined as having an arcuate portion terminating at a corner;

said action arm further including sockets defined along said arcuate portion adjacent said corner;

a spring biased ball detent within said base biased against said arcuate portion and arranged to engage said sockets to at least two positions;

a first of said sockets defined on said arcuate portion is configured to engage said ball detent to place said action arm in a door checking position where said arm is pivoted upwardly relative to said base to serve as a door check;

a second of said sockets is configured to engage said ball detent such that said action arm is pivoted slightly downwardly relative to said base so as to assume a trigger re-set position wherein said corner protrudes beyond said journal block;

whereby external interference with said protruding corner biases said action arm toward the door checking position.

2. The door check of claim 1 further characterized by:

said base attachment element includes a reversible intermediate wedge device;

whereby said check and its action arm may be configured at a preselected angle and optionally reversed.

3. The door check of claim 2 wherein said check base is attached to said intermediate wedge device by a bolt.

4. The door check of claim 2 wherein said check base is attached to said intermediate wedge device by tongue and groove features.

5. The door check of claim 1 further defined as including:

a third of said sockets defined on said arcuate portion configured to engage said ball detent so that the action arm is pivoted to a deactivated position when not needed.

* * * * *